United States Patent [19]

Burrous

[11] 4,049,563

[45] Sept. 20, 1977

[54] JET ENGINE OILS CONTAINING EXTREME PRESSURE ADDITIVE

[75] Inventor: Merwyn L. Burrous, El Cerrito, Calif.

[73] Assignee: Chevron Research Company, San Francisco, Calif.

[21] Appl. No.: 576,405

[22] Filed: May 12, 1975

Related U.S. Application Data

[63] Continuation-in-part of Ser. No. 371,198, June 18, 1973, abandoned.

[51] Int. Cl.[2] ..... C10M 1/20

[52] U.S. Cl. ..... 252/49.9; 252/49.6; 252/56 S

[58] Field of Search ..... 252/49.6, 49.9, 56 S

[56] References Cited

U.S. PATENT DOCUMENTS

| | | | |
|---|---|---|---|
| 3,247,111 | 4/1966 | Oberright et al. | 252/56 S X |
| 3,309,318 | 3/1967 | Aylesworth et al. | 252/56 S |
| 3,634,239 | 1/1972 | MacPhail et al. | 252/32.5 |
| 3,664,957 | 5/1972 | McCabe | 252/49.6 |
| 3,759,827 | 9/1973 | Groenhof et al. | 252/49.6 X |
| 3,790,478 | 2/1974 | Rudston et al. | 252/49.9 X |

FOREIGN PATENT DOCUMENTS

| | | | |
|---|---|---|---|
| 811,813 | 4/1959 | United Kingdom | 252/49.6 |

*Primary Examiner*—Delbert E. Gantz
*Assistant Examiner*—Andrew H. Metz
*Attorney, Agent, or Firm*—C. J. Tonkin; J. T. Brooks

[57] ABSTRACT

The load carrying capabilities of a jet engine oil consisting of an ester of a $C_4$–$C_{12}$ monocarboxylic acid and a polyol selected from pentaerythritol, dipentaerythritol, tripentaerythritol, trimethylol propane, trimethylol methane, trimethylol butane, neopentylglycol and mixtures thereof, are increased by incorporating into the jet engine oil from 4 to 8 weight percent of a soluble methyl phenyl polysiloxane having a kinematic viscosity ranging from 20 to 2,000 centistokes at 25° C.

4 Claims, No Drawings

JET ENGINE OILS CONTAINING EXTREME PRESSURE ADDITIVE

CROSS-REFERENCE TO RELATED APPLICATION

This is a continuation-in-part of application Ser. No. 371,198, filed June 18, 1973 and now abandoned.

DESCRIPTION OF THE INVENTION

Modern jet engines normally operate at high temperatures and under heavy work loads. As such, these engines demand a lubricant which can operate in a severe environment for prolonged periods. Conventional hydrocarbon mineral oils which form the base stock in the lubricants of most internal combustion engines are wholly insufficient at the elevated temperatures existent within a jet engine. The base stock which is typically employed is a synthetic base fluid such as carboxylic acid esters, polyphenyls, etc. Although when compounded with conventional antioxidants and metal deactivators, these synthetic base stocks are stable at the elevated temperatures existent within the jet engine, they do not possess the desired load carrying and antiwear properties necessary to adequately lubricate the engine. An oil which has the ability to lubricate moving parts under heavy loads is said to have desirable extreme pressure or EP properties.

In order to alleviate the lubricating deficiencies, additives must be incorporated within the synthetic base fluid. While there are a large number of extreme pressure and antiwear agents commercially available, there are only a few which can effectively function under the severe environment of the jet engine. This number is reduced even further when other properties of the additives must be maintained. For example, the additives must not have a deleterious effect on the rubber seals of the system.

It has been generally found in the past that those extreme pressure additives which can survive the hostile environment and effect good extreme pressure properties in a jet lubricant are harmful to the elastomeric seals causing shrinkage and degradation. Conversely, those additives which have been found compatible with the seals are either not satisfactory EP agents or cannot survive the hostile environment for prolonged periods.

Particularly difficult to satisfy are all the specifications and laboratory specifications for Naval Specification XAS-2354 which test is a qualifying test for jet engine oils used in Nave jet aircraft.

SUMMARY OF THE INVENTON

The oil composition of the present invention satisfies Naval Specification XAS-2354 and comprises a major portion of a synthetic lubricating oil consisting of an ester of a $C_4$–$C_{12}$ monocarboxylic acid and a polyol selected from pentaerythritol, dipentaerythritol, tripentaerythritol, trimethylol propane, trimethylol methane, trimethylol butane, neopentylglycol, and mixtures thereof, and from 4 to 8 weight percent of a soluble methyl phenyl silicone having a kinematic viscosity of 20 to 2,000 centistokes at 25° C. It was discovered that by incorporating a soluble dihydrocarbyl silicone into a synthetic fluid base that satisfactory extreme pressure properties of the lubricant can be obtained. Concomitantly, the silicone additive does not have a harmful effect on the rubber seals of the jet engine. It is especially important that the lubricating oil is compatible with the silicone elastomer seals since many additives which have been used previously to enhance the load carrying ability of a jet engine oil are highly detrimental to these materials. Furthermore, the stability of a compounded lubricant including the silicone additive has been found to possess the required thermal and oxidative stability at high temperatures similar to those present in an operating jet engine.

DETAILED DESCRIPTION OF THE INVENTION

An improved jet engine oil can be prepared by combining a major portion of the above defined polyolester synthetic lubricating oil which is stable at temperatures up to 500° F and from 4 to 8 weight percent, preferably from 4 to 5 weight percent of a soluble methyl phenyl polysiloxane (silicone) having a kinematic viscosity from 20 to 2,000 centistokes at 25° C and preferably from 75 to 500 centistokes at 25° C.

Polysilicone Additive

The methyl phenyl silicones which may be employed in the practice of this invention can be prepared by hydrolysis and condensation reactions as described in the art, for example in *An Introduction to the Chemistry of the Silicones,* by Eugene G. Rochow, John Wiley & Sons. Inc., N.Y., 2nd Ed.(1951).

The silicone compounds generally have the molecular weight within the range of about 500 to 4,000. The size of the molecule, however, is not usually expressed by reference to the molecular weight, but, rather, it is generally defined with a viscosity range. Thus, most of the silicone compounds useful in the practice of this invention have kinematic viscosities ranging from 20 to 2,000 centistokes at 25° C and preferably from 75 to 500 centistokes at 25° C.

The particular silicone additive which may be employed must be soluble within the synthetic base fluid in order to exhibit the desired extreme pressure properties. Generally, the additive must have a solubility of at least 30 g per liter of synthetic base fluid at 25° C and preferably 50 g per liter at 25° C.

The silicones which may be employed herein are commercially available from Dow Corning Corporation and from General Electric Company. Specific examples of methyl phenyl silicones which may be employed include the silicone marketed by the General Electric Company under their brand name SF-1153 having a viscosity at 25° C of 100 centistokes. Another fluid which may be employed is a phenyl methyl polysiloxane marketed by General Electric Company under the brand name SF-1038 which has a viscosity at 25° C ranging from 50 to 500 centistokes. Other suitable phenyl methyl polysiloxanes are those marketed by Dow Corning as Dow Corning 550 Fluid having a viscosity at 25° C of 125 centistokes and Dow Corning 710 Fluid having a viscosity at 25° C of 500 centistokes.

Synthetic Base Fluid

The synthetic base oil which make up the bulk of the jet lubricating oil are usually polyol esters of $C_4$ to $C_{12}$ straight or branched chained monocarboxylic acids. These compounds are prepared by reacting a polyol selected from pentaerythritol, dipentaerythritol, tripentaerythritol, trimethylol propane, trimethylcl ethane, trimethylol butane, neopentylglycol and mixtures thereof with carboxylic acids such as butyric acid, valeric acid, isovaleric acid, caproic acid, hexanoic acid, caprylic acid, pelargonic acid, capric acid, lauric acid, etc. Particularly good results are obtained with mixed esters of mono- and di-pentaerythritol with $C_5$–$C_{10}$ straight chain carboxylic acids. Exemplary synthetic fluid bases which are commercially available include Hercolube J, Hercolube B, Hercolube A, Hercolube C, all marketed by Hercules Incorp,; Unilever 14.636, Unilever 14,735, marketed by Unilever Corp.; and Stauffer Base stocks 700, 704, 800, marketed by Stauffer Chemical Company.

Other Additives

In addition to the methyl phenyl silicone additive, other additives may be incorporated into the synthetic base fluid without substantially affecting the extreme pressure properties of the polysilicone. Exemplary additives include antiwear agents such as tricresyl phosphate, alkyl phosphoric acids and their amine salts. Particularly preferred is the tricresyl phosphate. The antiwear agent is usually employed at a concentration from 0.5 to 5 weight percent, and preferably from 1 to 3 weight percent.

Another additive which may be employed is an antioxidant. Exemplary antioxidants include secondary aryl amine antioxidants, such as phenyl-alpha-naphthyl amine, p,p'-dioctylphenyl amine and phenothiazine. Hindered phenolic-type antioxidants may also be employed. Examples of these compounds include di-tert-butyl-p-cresol and 4,4'-methylene-bis(2,6-ditert-butylphenol), etc. The antioxidant may be present within the synthetic base fluid in an amount from 0.5 to 5 weight percent and usually from 1 to 3 weight percent.

Another type of additive which may be employed herein is a metal deactivator. This type of additive is employed to prevent or counteract catalytic effects of metal on oxidation, generally by forming catalytically inactive complexes with soluble or insoluble metal cations. Typical metal deactivators include complex organic nitrogen, oxygen and sulfur-containing compounds. Exemplary metal deactivators include mercaptobenzolthioazole, benzotiazole and 1,4-dihydroxyanthraquinone (quinizarin). This additive is usually present in an amount from 0.01 to 0.50 weight percent.

The following examples are presented to illustrate the practice of specific embodiments of this invention.

EXAMPLE 1

This example is presented to illustrate the improvement in extreme pressure properties of a lubricant which contains a representative methyl phenyl silicone of this invention. The sample test fluids are prepared and are tested in a Ryder Gear Test. The samples include Test Sample A composed of 95.58 weight percent of a mixed ester of mono- and di-pentaerythritol and $C_5$–$C_{10}$ straight chain monocarboxylic acids, 2.4 weight percent of tricresyl phosphate, 1 weight percent of phenyl-alpha-naphthyl amine, 1 weight percent of p,p'-dioctylphenyl amine and 0.02 weight percent of quinizarin.

Test Sample B is the same as Test Sample A except containing 3 weight percent of phenyl methyl polysiloxane marketed by Dow Corning as DC-550. Test Sample C is the same except containing 5 weight percent DC-550.

The Ryder Gear Test is described in ASTM-D-1947. It measures the gross surface damage between case-hardened spur gears in a four-square configuration. The loading on the gear teeth is incrementally increased. At each stage the gear tooth surface is inspected for scuffing. Ratings are in terms of "scuff load", or "failure load", the load at which 22.5% of the gear area is scored. Those lubricants having a high load at failure are preferred.

The results of the test samples in the Ryder gear test is reported in the following Table I.

TABLE I

RYDER GEAR RATING

| Test Fluid | Failure Load (Lb./in.) | % Relative Rating Compared to Reference Oil-Hercolube A |
|---|---|---|
| Reference Oil - Hercolube A | 2460 | — |
| Test Sample A - Base Fluid | 3115 | 125.6 |
| Test Sample B - 3% - Dow Corning 550 Fluid | 3335 | 135.6 |
| Test Sample C - 5% - Dow Corning 550 Fluid | 3590 | 144.7 |

The above Table illustrates the positive beneficial effect of the silicone additive on the gear tooth loading at failure. Three weight percent of the additive increased the failure load by 7 percent and 5 weight percent increased the failure load by 15 percent. The significance of this increase is indicated by the U.S. Navy Specification XAS-2354 for advanced jet engine oils which requires Ryder Gear rating greater than 144% of Reference Oil Hercolube A per single run. As can be seen, Test Sample C is the only oil in Table I to meet this requirement.

EXAMPLE 2

The example is presented to demonstrate the compatibility of the silicone additive with silicone rubber seals typically found in many jet aircraft engines. A test strip of the silicone rubber XS2/OS available from Rolls Royce Ltd. is cut from a sheet 0.085 inches thick. The test strip of measured volume is totally immersed in the sample lubricating oil, open to the atmosphere and maintained at a constant temperature of 100° C (212° F) for a period of 192 hours. At the end of the test period, the test strip is cooled by immersion in the same type of test lubricating oil except at ambient temperatures. The changes in volume of the test strip is measured after 30 minutes and then again after 48 hours of immersion in the ambient test oil.

The results of the test are reported in the following Table II for test cils A and C described in Example 1 and with a reference oil composed of Sample A with added lauryl phosphoric acid at the 0.46 Acid No. level. This compounding resembles that employed in some other jet engine lubricants in order to increase the Ryder Gear rating.

TABLE II

SILICONE RUBBER COMPATIBILITY

| Test Fluid | Volume Change (%) After 30 Min. | Volume Change (%) After 48 Hours |
|---|---|---|
| 1. Base Oil (Sample A) | + 5.5 | + 3.0 |
| 2. Base Oil + 5 wt. % Dow Corning 550 Fluid | + 5.3 | + 2.5 |
| 3. Reference Oil | − 4.7 | − 7.0 |

The above Table clearly illustrates the non-shrinkage effect from the use of the silicone addition. The test strip actually gained in volume which is not considered detrimental. The shrinkage of the volume, however, is highly deleterious and such is illustrated with the reference oil which constitutes behavior typical of a lubricant which is incompatible with silicone elastomers. The reference oil would fail the Ministry of Technology specification DFRD 2497 which permits no shrinkage of the silicone elastomer under these conditions. The oil containing 5 weight percent polysiloxane meets this requirement.

EXAMPLE 3

A jet engine oil was prepared with 90.96 weight percent of a mixed ester of mono- and di-pentaerythritol and $C_5$–$C_{10}$ straight chain monocarboxylic acids, 2.0 weight percent of tricresyl phosphate, 1.0 weight percent of phenyl-alpha-napthylamine, 1.0 weight percent of p,p'-dioctylphenyl amine, 0.04 weight percent of quinizarin and 5 weight percent of DC-550 methly phenyl siloxane, to which composition was added 10 ppm of a conventional foam inhibitor.

This oil was tested in Navy Specification XAS-2354, which test method is herein incorporated by reference. The test oil, denoted Sample D, meets the following laboratory tests of the Navy Specification Test XAS-2354.

| Physical Properties | Specification | Sample D |
|---|---|---|
| Viscosity, centistokes at 210° F (min) | 5.00 | 5.39 |
| Viscosity, centistokes at 210° F (max) | 5.50 | 5.39 |
| Viscosity, centistokes at 100° F (min) | 25 | 28.6 |
| Flash point (min) (COC) | 475° F | 505 |
| Pour point (max) | −65° F | −65 |
| Acid No. (max) | 0.50 | 0.03 |
| Viscosity centistokes at −40° F (max) | 13,000 | 10,180 |
| Evaporation at 400° F after 6½ hrs. (max) | 10% | 3.5% |
| Rubber Swell | | |
| Swelling of standard synthetic rubber (silicone) after 72 hours at 158° F range between | ±5 to +25% | +8.1% |
| Ryder Gear Test | | |
| Failure load % of Hercolube A (min) | 135 | 145 |
| High Temperature Deposition Test | | |
| After 48-hour test, the lubricant shall not exceed the following limits (average of 3 tests): | | |
| Total tube deposits (mg) | 15 (max) | 2 |
| Tube deposit rating | 20 (max) | 1.5 |
| Viscosity change at 100° F (%) | +45 (max) | 44 |
| Total Acid No. change | 3.0 (max) | 0.85 |
| Oil consumption (ml) | 200 (max) | 145 |
| Corrosion and Oxidation Stability | | |
| The oil shall conform to the limits of Table III below after being subjected to 72-hr. oxidation tests at 347° F, 400° F and 425° F | | |

TABLE III (SPECIFICATION TEST)

| Test Temp (° F) | Change in Vis at 100° F (max %) | Max Acid # | Max Metal Wt. Change (mg/cm²) Steel | Silver | Alum | Magn | Copper | Bronze | Titanium |
|---|---|---|---|---|---|---|---|---|---|
| 347 | +15 | 1 | ±0.2 | ±0.2 | ±0.2 | ±0.2 | ±0.2 | — | — |
| 400 | +30 | 3 | ±0.2 | ±0.2 | ±0.2 | ±0.2 | — | ±0.4 | — |
| 425 | +70 | 10 | ±0.2 | ±0.2 | ±0.2 | — | — | — | ±0.2 |

TABLE IV (TEST SAMPLE D)

| Test Temp (° F) | Change in Vis at 100° F (%) | Acid # | Metal Wt Change (mg/cm²) Steel | Silver | Alum | Magn | Copper | Bronze | Titanium |
|---|---|---|---|---|---|---|---|---|---|
| 347 | 6.6 | 0.2 | 0 | 0 | 0 | 0 | −0.05 | — | — |
| 400 | 16.8 | 0.7 | −0.04 | −0.01 | −0.04 | 0 | — | −0.02 | — |
| 425 | 39 | 6.3 | +0.02 | −0.02 | 0.0 | — | — | 0.0 | −0.01 |

It is apparent that many widely different embodiments may be made without departing from the scope and spirit thereof.

What is claimed is:

1. A composition of matter comprising a major portion of a synthetic lubricating oil consisting of an ester of a $C_4$–$C_{12}$ monocarboxylic acid and a polyol selected from pentaerythritol, dipentaerythritol, tripentaerythritol, trimethylol propane, trimethylol methane, trimethylol butane, neopentylglycol, or mixtures thereof and from 4 to 8 weight percent of a soluble methyl phenyl polysiloxane having a kinematic viscosity of 20 to 2,000 centistokes at 25° C.

2. The composition defined in claim 1 wherein said polysiloxane has a solubility in said synthetic lubricating oil of at least 30 g per liter at 25° C.

3. The composition defined in claim 1 wherein said synthetic base oil is a mono- or di-pentaerylthritol ester of a $C_5$–$C_{12}$ straight and branched chain hydrocarbon monocarboxylic acid or mixtures thereof.

4. A lubricating oil composition for jet engines consisting essentially of a major portion of a synthetic base oil consisting of mono- and di-pentaerythritol esters of $C_5$ to $C_{10}$ straight and branched chain hydrocarbon monocarboxylic acid or mixtures thereof, from 4 to 8 weight percent of methyl phenyl silicone having a kinematic viscosity of 75 to 500 centistokes at 25° C, from 0.5 to 5 weight percent of a phosphate antiwear agent, from 0.5 to 5 weight percent of a secondary aryl amine antioxidant and from 0.01 to 0.5 weight percent of 1,4-dihydroxy anthraquinone a metal deactivator.

* * * * *